US010458105B2

(12) United States Patent
Lulay et al.

(10) Patent No.: US 10,458,105 B2
(45) Date of Patent: Oct. 29, 2019

(54) MAGNETIC SINK INSERT

(71) Applicants: Steven Lulay, Stayton, OR (US); Ronelle Lulay, Stayton, OR (US)

(72) Inventors: Steven Lulay, Stayton, OR (US); Ronelle Lulay, Stayton, OR (US)

( * ) Notice: Subject to any disclaimer, the term of this patent is extended or adjusted under 35 U.S.C. 154(b) by 13 days.

(21) Appl. No.: 15/899,938

(22) Filed: Feb. 20, 2018

(65) Prior Publication Data

US 2019/0063052 A1 Feb. 28, 2019

Related U.S. Application Data

(60) Provisional application No. 62/551,403, filed on Aug. 29, 2017.

(51) Int. Cl.

| | |
|---|---|
| ***E03C 1/26*** | (2006.01) |
| ***E03C 1/28*** | (2006.01) |
| ***B03C 1/033*** | (2006.01) |
| ***B03C 1/28*** | (2006.01) |
| *E03C 1/266* | (2006.01) |

(52) U.S. Cl.

CPC ..... *E03C 1/26* (2013.01); *B03C 1/0332* (2013.01); *B03C 1/286* (2013.01); *B03C 2201/20* (2013.01); *E03C 1/266* (2013.01)

(58) Field of Classification Search

CPC ..... E03C 1/26; E03C 1/266; B03C 1/0332; B03C 1/286

USPC ..... 4/654

See application file for complete search history.

(56) References Cited

U.S. PATENT DOCUMENTS

| | | | | |
|---|---|---|---|---|
| 4,494,657 | A | 1/1985 | Oldenkamp | |
| 4,692,948 | A * | 9/1987 | Martin | E03C 1/262 206/818 |
| 4,706,818 | A | 11/1987 | Zutell et al. | |
| 6,000,643 | A | 12/1999 | Gelder | |
| 6,347,759 | B1 | 2/2002 | Sedlak | |
| 7,181,782 | B2 * | 2/2007 | Mayer | E03C 1/22 4/686 |
| 9,045,884 | B1 | 6/2015 | Harden | |

* cited by examiner

*Primary Examiner* — Tuan N Nguyen

(74) *Attorney, Agent, or Firm* — Global Intellectual Property Agency, LLC; Daniel Boudwin

(57) ABSTRACT

A magnetic sink insert. The magnetic sink insert includes a first ring including an upper portion, a lower portion, an outer wall, and an interior wall defining an opening. The inner diameter of the upper portion is equal to the inner diameter of the lower portion, and the outer diameter of the upper portion is greater than the outer diameter of the lower portion. The lower portion is configured to removably engage a sink drain via a frictional fit or a threaded connection therewith. In one embodiment, a plurality of posts extends upwardly from the first ring, and a second ring is affixed to the upper ends of the plurality of posts. The first and second rings include a magnetic material. The magnetic material attracts metallic utensils and other metallic objects to the interior walls of the rings, preventing metallic objects from falling into a garbage disposal.

8 Claims, 4 Drawing Sheets

MAGNETIC SINK INSERT

CROSS REFERENCE TO RELATED APPLICATIONS

This application claims the benefit of U.S. Provisional Application No. 62/551,403 filed on Aug. 29, 2017. The above identified patent application is herein incorporated by reference in its entirety to provide continuity of disclosure.

BACKGROUND OF THE INVENTION

The present invention relates to kitchen sink accessories. More specifically, the present invention provides a magnetic sink insert that is removably securable within a sink drain in order to prevent metallic objects from falling into the garbage disposal.

Many kitchen sinks include a garbage disposal, which shreds food waste into small pieces so that it can pass through plumbing. The garbage disposal is installed under a kitchen sink between the sink's drain and trap. While garbage disposals effectively remove organic waste, they are prone to breaking when an inorganic object enters the mechanism. The most common instance of this is a metallic utensil accidentally flowing down the sink drain into the disposal unit. The metallic utensil often causes a running disposal to seize up. An individual must manually remove the utensil and reset the garbage disposal, which can be a difficult and time-consuming process. Further, the utensil is often damaged and must be thrown out. In some cases, the garbage disposal itself can be broken beyond repair by a metallic object, and it is costly and time-consuming to replace. In view of the above, there is need for a device that can be installed within a sink basin to prevent metallic utensils and other metallic objects from accidentally falling into the garbage disposal.

Devices have been disclosed in the known art relating to magnetic utensil retainers for preventing metal objects from entering a garbage disposal. However, these devices have several drawbacks. One such device is a flexible metallic band that can be inserted into a drain pipe. While the metallic band can attract metal objects, this device can potentially become dislodged or slide down the pipe, where it is unable to be retrieved without disassembly of the sink drain components. Another device includes a series of apertures lined with magnetic material. However, this device prevents larger non-metallic objects from falling into the garbage disposal, which may prevent food that should be disposed of from falling into the disposal.

In light of the devices disclosed in the known art, it is submitted that the present invention substantially diverges in design elements from the known art and consequently it is clear that there is a need in the art for an improvement to existing magnetic sink insert devices. In this regard the present invention substantially fulfills these needs.

SUMMARY OF THE INVENTION

In view of the foregoing disadvantages inherent in the known types of magnetic sink inserts now present in the prior art, the present invention provides a magnetic sink insert wherein the same can be utilized for providing convenience for the user when preventing metallic utensils and other metallic objects from falling into a garbage disposal. The magnetic sink insert includes a first ring including an upper portion, a lower portion, an outer wall, and an interior wall defining an opening. An inner diameter of the upper portion is equal to an inner diameter of the lower portion, and an outer diameter of the upper portion is greater than an outer diameter of the lower portion. The lower portion is configured to removably engage a sink drain. The first ring includes a magnetic material which is configured to attract metallic objects such as metallic utensils in order to prevent them from falling into the garbage disposal.

One object of the present invention is to provide a magnetic sink insert that is improved over, and includes none of the disadvantages of, devices in the known art.

Another object of the present invention is to provide a magnetic sink insert that includes an upper portion composed of a magnetic material and a lower portion composed of a non-magnetic material.

A further object of the present invention is to provide a magnetic sink insert that includes a first ring affixed to a second ring via a plurality of posts extending upwardly from an upper surface of the first ring.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
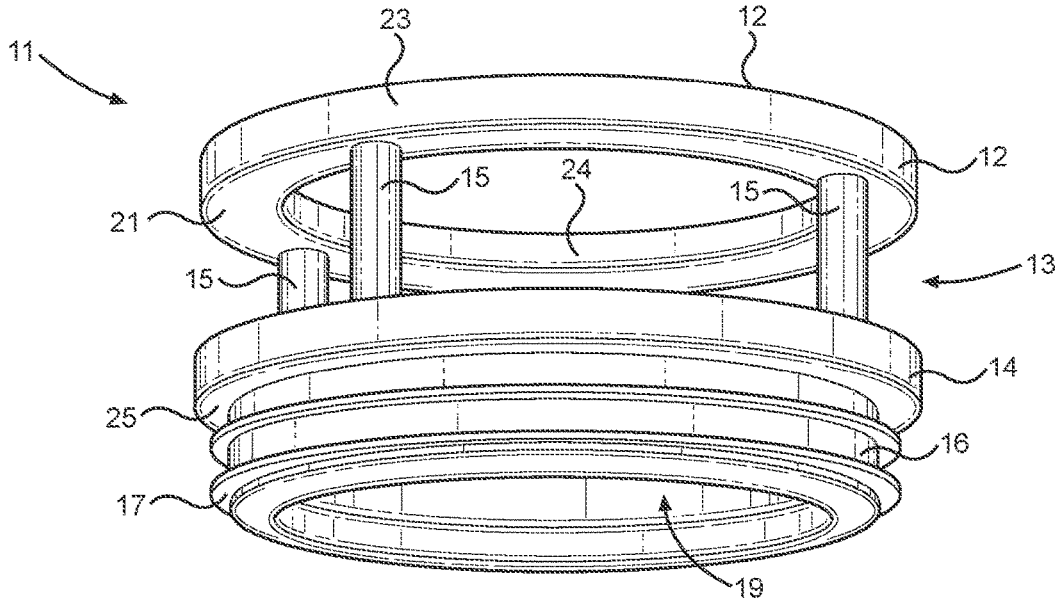
FIG. 1A shows a bottom perspective view of one embodiment of the magnetic sink insert.

Reference is made herein to the attached drawings. Like reference numerals are used throughout the drawings to depict like or similar elements of the magnetic sink insert. For the purposes of presenting a brief and clear description of the present invention, the preferred embodiment will be discussed as used for preventing metallic utensils and other metallic objects from falling into a garbage disposal. The figures are intended for representative purposes only and should not be considered to be limiting in any respect.

Figure 1B:
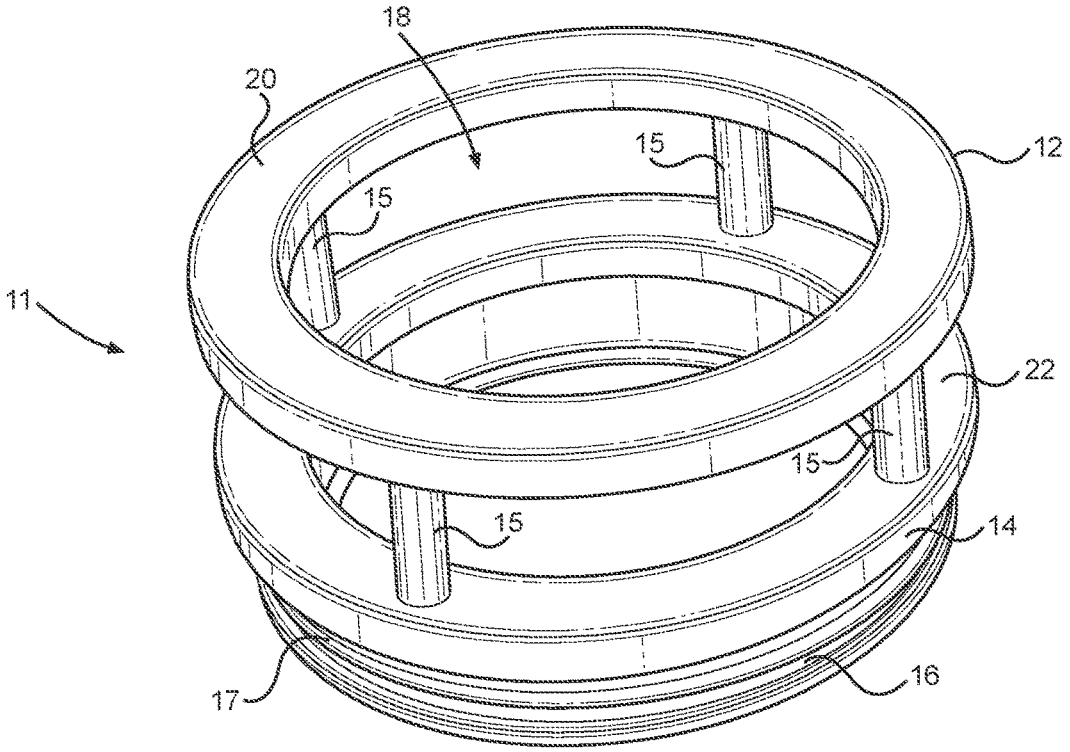
FIG. 1B shows a top perspective view of one embodiment of the magnetic sink insert.

Referring now to FIGS. 1A and 1B, there is shown a bottom perspective view of one embodiment of the magnetic sink insert and a top perspective view of one embodiment of the magnetic sink insert, respectively. In the shown embodiment, the magnetic sink insert 11 includes a first ring 14 including an upper portion 25, a lower portion 16, and an opening 19. The upper and lower portions 25, 16 include equal inner diameters, creating a smooth channel for food particles to pass therethrough. The lower portion 16 includes an outer diameter that is less than an outer diameter of the upper portion 25, such that the lower portion 16 may be inserted into a sink drain. In the shown embodiment, the lower portion 16 includes threading 17 thereon such that it may threadably engage a threaded sink drain or the threaded upper end of a garbage disposal. In alternate embodiments, the lower portion 16 has no threading and is configured to removably secure to a sink drain via a friction fit. In such embodiments where a frictional fit is contemplated, the outermost walls of the first and second rings 14, 12 may include a high friction material thereon, such as rubber, in order to prevent slippage of the insert.

In the illustrated embodiment, a plurality of posts 15 are disposed on an upper surface 22 of the first ring 14. A second ring 12 is affixed to the upper ends of the posts 15. In the shown embodiment, the posts 15 are positioned along the first ring 14 equidistant from each other, in order to evenly distribute the force and stabilize the connection between the two rings 14, 12. The first and second rings 14, 12 each include a magnetic material. The magnetic material may be disposed throughout the entirety of the rings 14, 12, or alternatively may be disposed solely on the inner sidewalls of the rings 14, 12. The inner diameter of the second ring 12 is equal to the inner diameters of the upper and lower portions of the first ring 14, and the outer diameter of the second ring 12 is equal to the outer diameter of the upper portion 25 of the first ring 14, and greater than the outer diameter of the lower portion 16 of the first ring 14. The use of two rings allows for additional attachment surfaces for attracted metallic objects, and provides a space 13 between rings for embodiments that connect directly to a garbage disposal, allowing an upper surface 20 of the second ring to be flush with a lower surface of a sink basin.

Figure 2A:
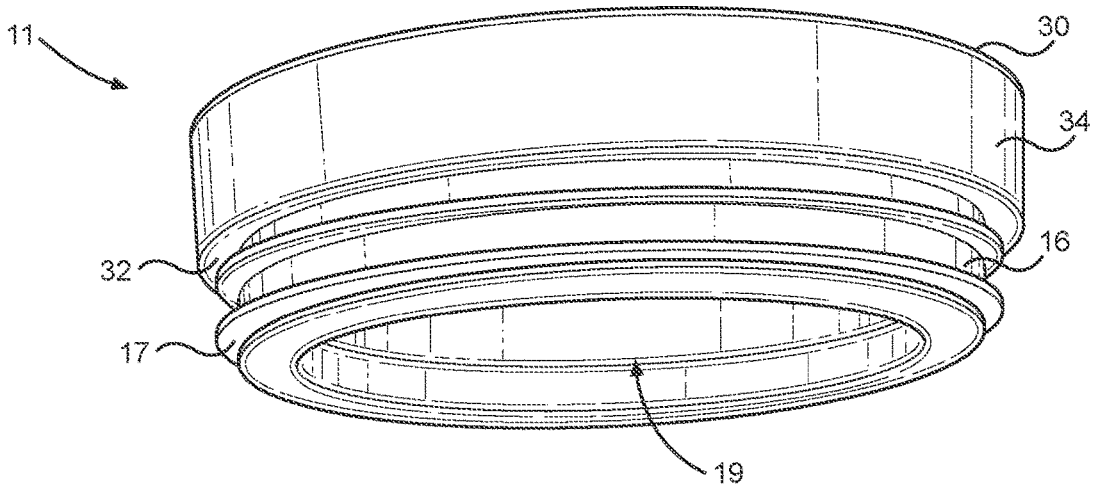
FIG. 2A shows a bottom perspective view of an alternate embodiment of the magnetic sink insert.
Figure 2B:
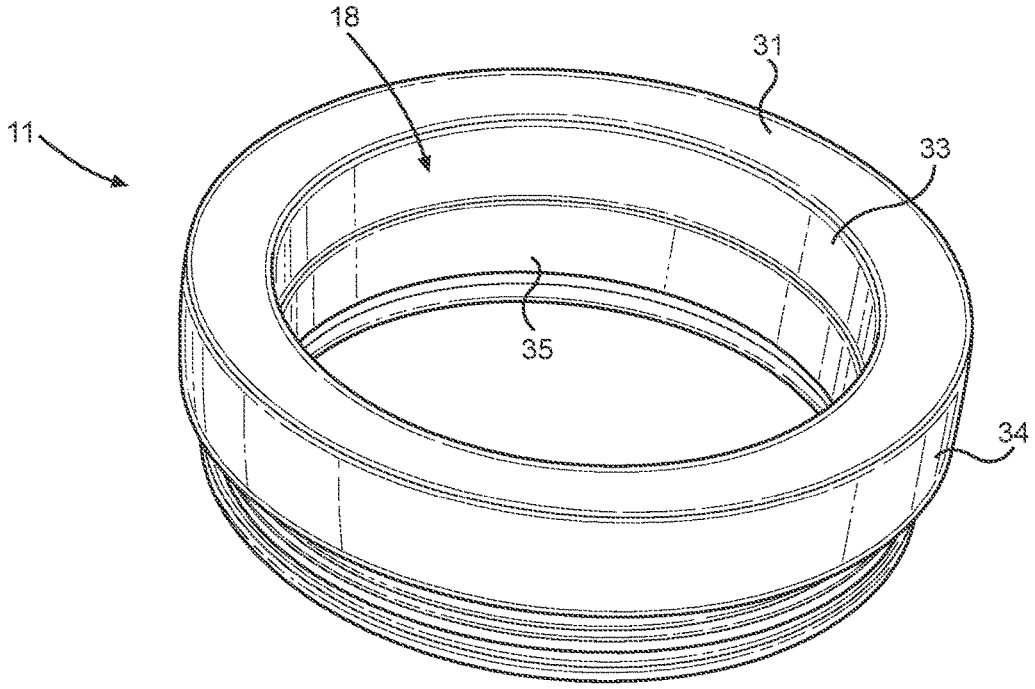
FIG. 2B shows a top perspective view of an alternate embodiment of the magnetic sink insert.

Referring now to FIGS. 2A and 2B, there is shown a bottom perspective view of an alternate embodiment of the magnetic sink insert and a top perspective view of an alternate embodiment of the magnetic sink insert, respectively. In the shown embodiment, the magnetic sink insert includes only a first ring 34 having a planar upper surface 30, an upper portion 32, and a lower portion 16 having optional threading 17 thereon, defining an upper opening 18 and lower opening 19. The inner diameter of the upper portion 32 is equal to the inner diameter of the lower portion 16, such that the inner wall 33 of the upper portion 32 is flush with the inner wall 35 of the lower portion 16. The outer diameter of the upper portion 32 is greater than the outer diameter of the lower portion 16, such that the outer wall 34 of the upper portion 32 extends past the lower portion 16. In some embodiments, the upper portion 32 is composed of a magnetic material, while the lower portion 16 is composed of a non-metallic material, allowing the insert to be more easily removed if needed.

Figure 3:
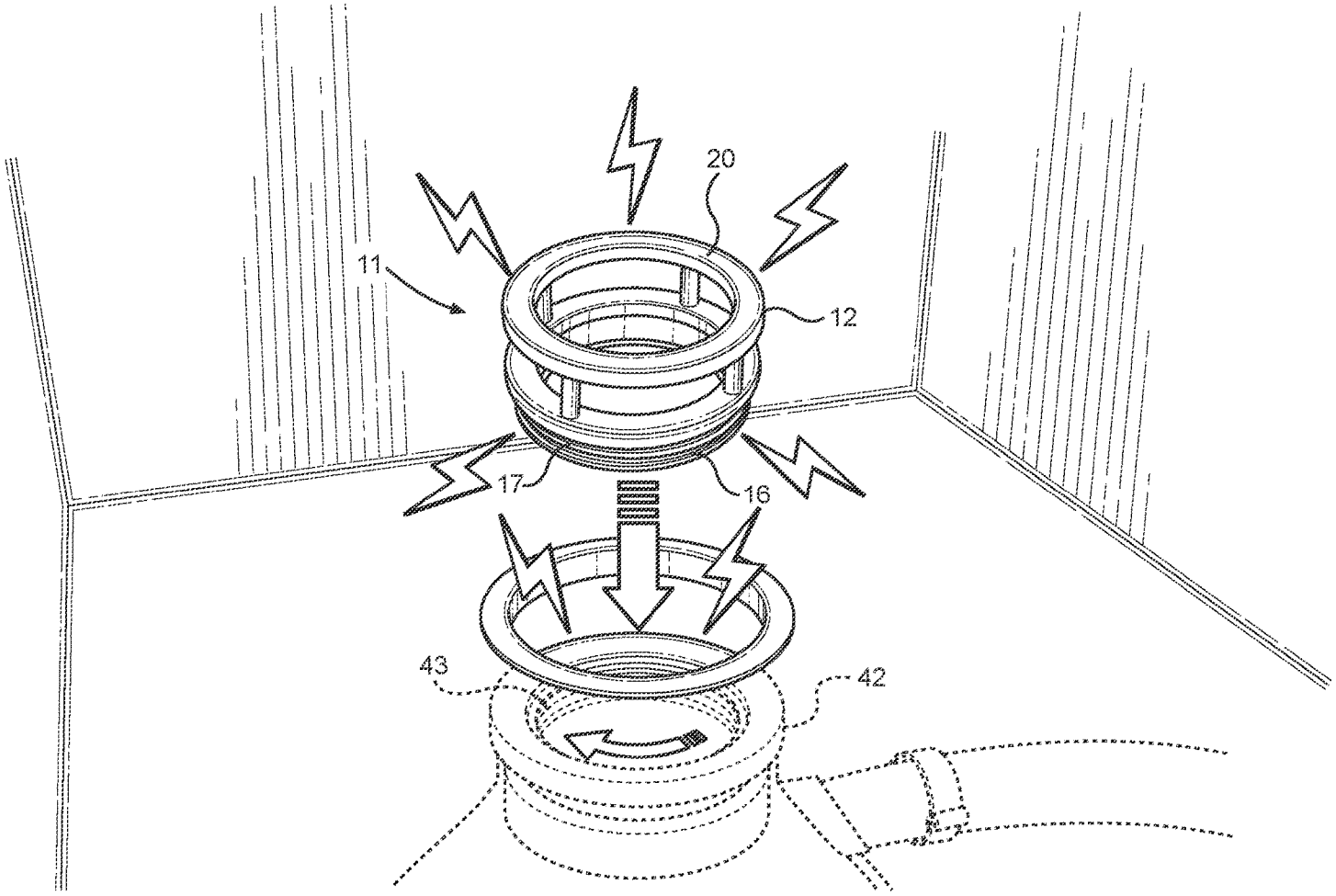
FIG. 3 shows a perspective view of one embodiment of the magnetic sink insert being inserted into a sink drain.

Referring now to FIG. 3, there is shown a perspective view of one embodiment of the magnetic sink insert being inserted into a sink drain. In the shown embodiment, a garbage disposal 42 includes a threaded opening 43. The threaded 17 lower portion 16 of the insert 11 can be secured to the threaded opening 43 of the garbage disposal, while the second ring 12 extends upwardly therefrom, such that an upper surface 20 is flush with the sink basin.

Figure 4:
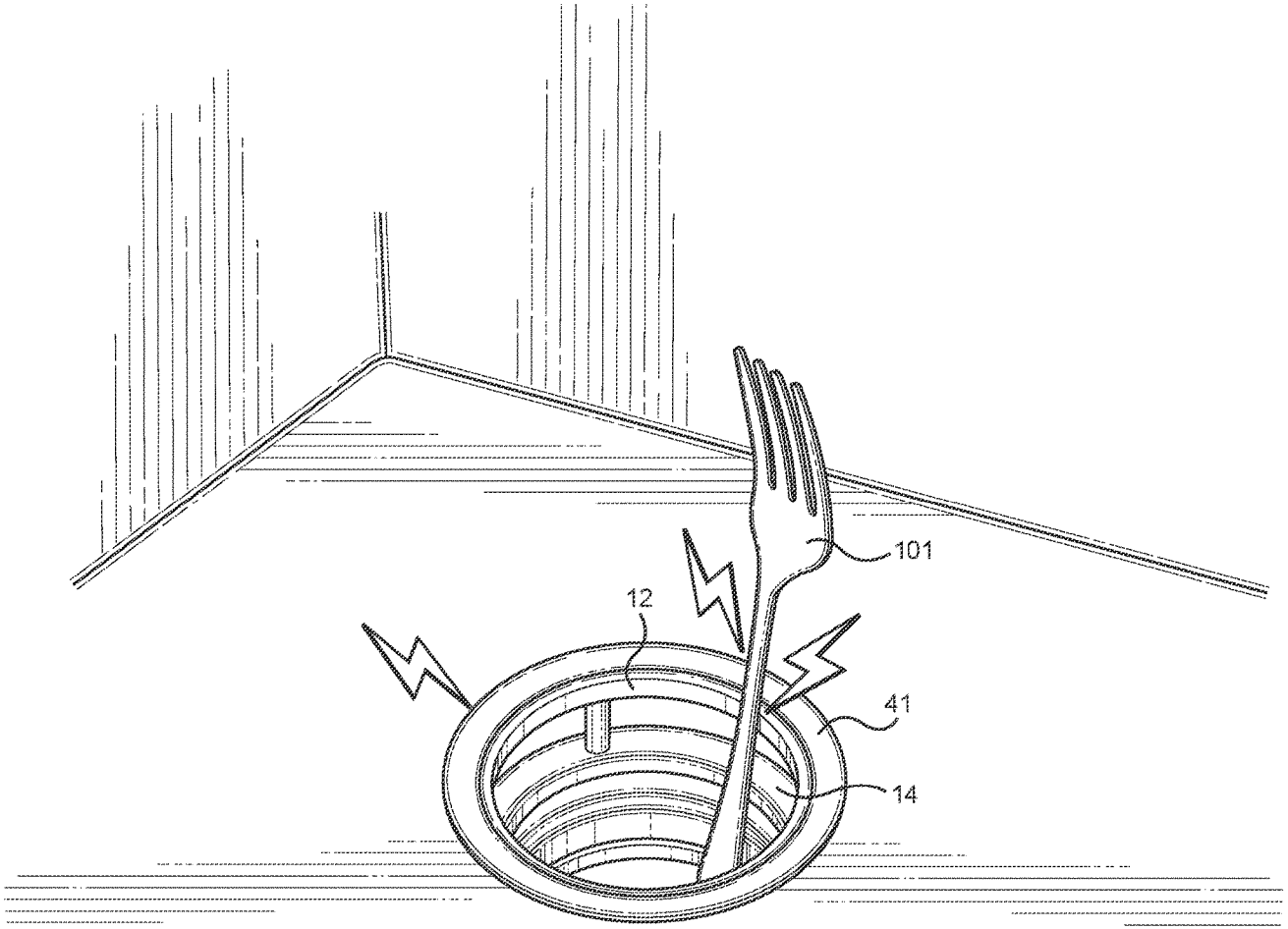
FIG. 4 shows a perspective view of one embodiment of the magnetic sink insert in use.

Referring now to FIG. 4, there is shown a perspective view of one embodiment of the magnetic sink insert in use. When the insert is installed, a metallic utensil 101 falling through the sink drain is attracted to the magnetic materials of the first ring 14 and the second ring 12, causing the utensil to temporarily adhere thereto rather than travel into the garbage disposal. An individual may simply grasp and remove the utensil from the rings. Further, the install sink insert includes an uppermost surface 41 that is flush with the sink basin, providing for a clean appearance.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A magnetic sink insert, comprising:

a first ring including an upper portion and a lower portion, the first ring including an outer wall and an interior wall defining an opening;

wherein the interior wall is a continuously smooth surface;

wherein the interior wall defines an uninterrupted open space through which material is able to flow;

wherein an inner diameter of the upper portion is equal to an inner diameter of the lower portion;

wherein an outer diameter of the upper portion is greater than an outer diameter of the lower portion;

wherein the first ring includes a magnetic material;

wherein the lower portion is configured to removably engage a sink drain.

2. The magnetic sink insert of claim 1, wherein the upper portion of the first ring is composed of a magnetic material, and wherein the lower portion of the first ring is composed of a non-magnetic material.

3. The magnetic sink insert of claim 1, further comprising threading disposed on the lower portion of the first ring.

4. The magnetic sink insert of claim 1, further comprising:

a plurality of posts disposed on an upper surface of the first ring, the plurality of posts extending upwardly perpendicularly from the upper surface;

a second ring affixed to upper ends of the plurality of posts, the second ring including a magnetic material.

5. The magnetic sink insert of claim 4, wherein an outer diameter of the second ring is equal to the outer diameter of the upper portion of the first ring and the outer diameter of the lower portion of the first ring.

6. The magnetic sink insert of claim 4, wherein an inner diameter of the second ring is equal to the inner diameter of the upper portion of the first ring.

7. The magnetic sink insert of claim 4, wherein the plurality of posts are spaced equidistant from one another along the upper surface of the first ring.

8. The magnetic sink insert of claim 4, wherein an upper surface of the second ring is configured to be flush with a lower surface of a sink basin when the first ring is removably secured within a sink drain.

* * * * *